US005888710A

United States Patent [19]

Adachi et al.

[11] Patent Number: 5,888,710

[45] Date of Patent: Mar. 30, 1999

[54] SILVER HALIDE PHOTOGRAPHIC LIGHT SENSITIVE MATERIAL

[75] Inventors: Hitoshi Adachi; Yasuo Kurachi; Eiichi Ueda; Takayuki Sasaki, all of Hino, Japan

[73] Assignee: Konica Corporation, Tokyo, Japan

[21] Appl. No.: 978,095

[22] Filed: Nov. 25, 1997

Related U.S. Application Data

[63] Continuation of Ser. No. 706,891, Sep. 3, 1996.

[30] Foreign Application Priority Data

Sep. 8, 1995 [JP] Japan ..... 7-231445

[51] Int. Cl.[6] ..... G03C 1/91; G03C 1/09

[52] U.S. Cl. ..... 430/523; 430/567; 430/603; 430/966

[58] Field of Search ..... 430/567, 603, 430/523, 531, 537, 966, 488

[56] References Cited

U.S. PATENT DOCUMENTS

| | | | |
|---|---|---|---|
| 5,320,938 | 6/1994 | House et al. | 430/567 |
| 5,453,350 | 9/1995 | Kurachi et al. | 430/527 |
| 5,455,146 | 10/1995 | Nishikawa et al. . | |

FOREIGN PATENT DOCUMENTS

| | | |
|---|---|---|
| 0 660 174 A2 | 6/1995 | European Pat. Off. . |
| 0 695 969 A1 | 2/1996 | European Pat. Off. . |
| 0 760 491 A1 | 3/1997 | European Pat. Off. . |

*Primary Examiner*—Thorl Chea

*Attorney, Agent, or Firm*—Frishauf, Holtz, Goodman, Langer & Chick, P.C.

[57] ABSTRACT

A silver halide photographic light sensitive material is disclosed, comprising a support having on the support a silver halide emulsion layer comprising silver halide grains, wherein at least 50% of the total grain projected area is accounted for by tabular grains having an aspect ratio of 2 or more, at least one of subbing layers provided on both sides of the support comprising colloidal tin oxide sol.

6 Claims, No Drawings

SILVER HALIDE PHOTOGRAPHIC LIGHT SENSITIVE MATERIAL

This application is a Continuation of application Ser. No. 08/706,891, filed Sep. 3, 1996.

FIELD OF THE INVENTION

The present invention relates to a silver halide photographic light sensitive material, particularly a silver halide photographic light sensitive material improved in antistatic property and fixability even when subjected to rapid-processing at a low replenishing rate.

BACKGROUND OF THE INVENTION

Recently, with an increase of consumption of silver halide photographic light sensitive materials, the processing amount thereof is increasing so that there have been demands for further shortening of the processing time.

In the field of X-ray photographic light sensitive materials for medical use, rapid processing is demanded due to the increased number of radiographs caused by the increased frequency of diagnoses and radiographing items necessary for prompt diagnoses. Especially, in the field where processing within a short time is required such as arteriography and radiographing during surgical operation, rapid processing is essential.

To meet the environment regulation, low replenishment has been advanced to reduce effluents from processing tanks. Recently, there is spotlighted a replenishing method, in which a solid processing composition is directly supplied to a processing tank of an automatic processor to decrease effectively a replenishing rate However, when processed at a super high speed and low replenishment rate, it resulted in processing variations and deterioration in image quality. As well recognized in the art, silver chloride is superior in processability as compared to other silver halides and effect of a chloride ion on a developer is also less than that of a bromide or iodide ion, so that exhaustion of a developer due to accumulation of halide ions can be avoided by the use of silver chloride. However, silver chloride cannot achieve high sensitivity.

To meet the demands for the rapid processing, recently, a tabular silver halide grains have been employed. Since the specific surface area of the tabular silver halide grains is large, sensitizing dye can be adsorbed to the grains in a large amount so that spectral sensitivity can be enhanced. Tabular chloride-containing grains with two parallel {100} major faces are disclosed in European Patent 534,395 and U.S. Pat. Nos. 5,264,337 and 5,320,938.

There is such a problem that a photographic material is subject to electrification due to friction with a transport roller of a processor when being processed at a high speed or due to peeling from other photographic materials when being inserted into the processor, thereby causing so-called static mark fog. In particular, a photographic material with the use of a high sensitive tabular grain emulsion is remarkable in such tendency.

Accordingly, it is necessary to provide sufficient antistatic property to photographic material. Various antistatic means have been studied so far, such as an agent for adjusting triboelectric series and organic conductive compounds. However, it was found that these compounds were accumulated in a processing solution, which were attached to a photographic material as sludge at the time when subjected to rapid processing at a low replenishing rate, thereby resulting in insufficient clearness.

SUMMARY OF THE INVENTION

In view of the above circumstances, the present invention was accomplished. Thus, an object of the invention is to provide a silver halide photographic material suitable for forming a radiographic image and with high sensitivity, improved antistatic property and fixability, and little variation even when subjected to rapid processing at a low replenishing rate, whereby a image forming method and processing method.

The object of the present invention is accomplished by

- a silver halide photographic material comprising a support having on the support a silver halide emulsion layer comprising tabular grains having an aspect ratio of 2 or more and accounting for 50% or more of the total grain projected area, at least one of subbing layers provided on both sides of the support comprising colloidal tin oxide sol;
- said tabular grains having two parallel {100} major faces and containing 20 mol % or more of silver chloride;
- said tabular grains have been selenium-sensitized or tellurium-sensitized;
- said photographic material is a double emulsion light sensitive material, which is exposed imagewise to X-ray across a fluorescent intensifying screen capable of absorbing not less than 45% of X-ray with an X-ray energy of 80 kVp and containing a fluorescent substance having a thickness of 135 to 200 $\mu$m, in a packing density of not less than 68%;
- a processing method, in which said photographic material is processed by use of an automatic processor provided with a means for supplying a solid processing composition to a processing bath;
- a processing method, in which said photographic material is processed with a developer, in the presence of a compound represented by formula (1); and
- a processing method, in which said photographic material is processed using an automatic processor with a drying section provided with a heat roller.

Thus, inventors found that sufficient clearness can be achieved by providing a subbing layer containing a colloidal tin oxide sol, even when rapid-processed at a low replenishing rate.

DETAILED DESCRIPTION OF THE INVENTION

In the invention, a colloidal tin oxide sol is used as an antistatic agent. From a behavior that particles having a size of $10^{-5}$ to $10^{-7}$ cm in diameter are stable in the form of a dispersion, such magnitude is referred to as a colloidal dimension, so that particles with a size of the colloidal dimension are referred to as colloidal particles. Thus, the word, "colloidal tin oxide sol" in the invention means tin oxide in the form of a dispersion of solid particles with a diameter of $10^{-5}$ to $10^{-7}$ cm.

The colloidal tin oxide sol is contained in a subbing layer in an amount of 100 to 1000 mg/M$^2$, preferably 200 to 700 mg/m$^2$.

The colloidal tin oxide sol used in the invention can be prepared, for example, by dispersing super fine particles of the tin oxide in an appropriate solvent or through decomposition reaction in a solvent capable of dissolving a tin compound.

In the preparation of the colloidal tin oxide by the use of the super fine particles, the temperature condition is important. A method with heat treatment at a high temperature is not preferred because of growth of primary articles and appearance of crystalinity. In the case when beat treatment is inevitable, the treatment is carried out a temperature of not higher than 300° C., preferably not higher 200° C., and more preferably not higher than 150° C. However, heating at 150° to 250° C. is preferable for dispersion in a binder.

A preparing process of isolation of the tin oxide prepared by spraying a tin compound prepared by a wet process in a electric furnace or through pyrolysis at a high temperature, followed by dispersing the prepared tin oxide in a solvent is not suitable for the use as a photographic antistatic agent because of difficulty in dispersion or occurrence of particle coagulation.

In the case where a solvent used for preparing the tin oxide sol dispersion is not miscible with a protective colloidal binder, to replace it by a solvent suitable for dispersing in a binder, a compound capable of being miscible with the solvent used in the preparation and dispersing stably the tin oxide is optionally added and heating is made at a temperature of not higher than 300° C., preferably not higher than 200° C. and more preferably not higher than 150° C. to dry the tin oxide superfine particles with the compound. The resulting superfine particles are dispersed in water or an aqueous mixture with a solvent.

As tin compounds used in a preparation method by decomposition reaction of a solvent-soluble tin compound are cited a compound containing an oxo-anion, such as $K_2SnO_3\mathbf{3}H_2O$; water-soluble halide compound, such as $SnCl_4$; organic metal compound having a structure of $R'_2SnR_2$, $R_3SnX$ or $R_2SnX_2$, such as $(CH_3)_3SnCl$(pyridine) or $(C_4H_9)_2Sn(OCC_2H_5)_2$; and oxo-salt such as $Sn(SO_4)_2$ $2H_2O$.

The solvent soluble compound is dissolved in a solvent and then subjected to a physical treatment such as heating or applying pressure or chemical treatment such as oxidation, reduction or hydrolysis to prepare the tin oxide sol directly or through an intermediate. Japanese Patent examined No. 35-6616 describes a method in which $SnCl_4$ was dissolved in 100 times volume of distilled water to precipitate stannic hydroxide, then, aqueous ammonia was added thereto to dissolve the precipitates and heating was applied until ammonia odor is lost to prepare a colloidal tin oxide sol.

As solvents, besides water, are usable a alcohol such as methanol, ethanol or iso-propanol; ether such as tetrahydrofuran, dioxane or diethyl ether; aliphatic organic solvent such as hexane or heptane and aromatic organic solvent such as benzene or pyridine, in accordance with the type of tin compounds. Among these are preferred water and alcohols.

According to this method can be added, during the course of preparation, a compound containing an element other than tin. Fluorine-containing compound and tri- or penta-coordinated metal compound, for example, can be introduced.

The solvent soluble, fluorine-containing compounds, which may be an ionic compound or covalent compound, includes a metal fluoride, such as $K_2TiF_6$, HF, $KHF_2Sb$ and $F_3MoF_6$; fluoro-complex anion, such as $NH_4MnF_3$ and $NH_4BiF_4$; inorganic molecular fluoro compound, such as $Br_{F3}$, $SF_4$ and $SF_6$; organic fluoro compound, such as $CF_3I$, $CF_3COOH$ and $P(CF_3)_3$. In case of the solvent being water, a combination of the fluorine containing compound with nonvolatile compound, such as a combination of $CaF_2$ and sulfuric acid, may be usable.

The solvent soluble metal compound capable of forming trivalent or pentavalent coordination is a compound containing a III-group element, such as Al, Ga, In or Tl; V-group element, such as P, As, Sb or Bi; transitional metal capable of forming tri or penta-coordination bonds, such as Nb, V, Ti, Cr, Mo, Fe, Co or Ni.

Synthesis Example-1 of colloidal tin oxide dispersion

Stannic chloride hydrate of 65 g was dissolved in 2000 cc of a water/ethanol mixture to obtain a solution. Subsequently, the solution was boiled to obtain co-precipitates. The resulting precipitates were washed several times with distilled water by decantation. After confirming no reaction with chloride ions by adding dropwise silver nitrate to the distilled water used for washing, to the precipitate was added water to total amount of 2000 cc. Further, 40 cc of aqueous ammonia was added thereto and the mixture solution was heated to obtain a colloidal gel dispersion.

Synthesis Example-2 of colloidal tin oxide dispersion

Stannic chloride hydrate of 65 g and antimonyl trichloride of 1.0 were dissolved in 2000 cc of a water/ethanol mixture to obtain a solution. Subsequently, the solution was boiled to obtain coprecipitates. The resulting precipitates were washed several times with distilled water by decantation. After confirming no reaction with chloride ions by adding dropwise silver nitrate to the distilled water used for washing, to the precipitate was added water to total amount of 2000 cc. Further, 40 cc of aqueous ammonia was added thereto and the mixture solution was heated to obtain a colloidal gel dispersion.

Thus prepared tin oxide sol was proved to have a specific volume resistance of $2.1\times10^5$ Ωcm.

Silver halide grains used in the present invention (hereinafter, also referred to as tabular silver halide grains) are tabular grains having two parallel (100) major faces and an aspect ratio of not less than 2.0, preferably less than 15.0. The word, "major faces" refers to two parallel faces with largest area among crystal faces constituting substantially rectangular emulsion grains, and the aspect ratio is defined as a ratio of an equivalent circular diameter of the major faces to a thickness between the major faces.

The equivalent circular diameter of the major faces can be determined by photographing the grains magnified at 10,00 to 50,000 time with an electronmicroscope and measuring the projected area of the grain. Similarly, the grain thickness can also be determined from electronmicrograph.

The fact that the major faces were (100) faces can be confirmed by electron diffraction method or X-ray diffraction method. The grains having (100) major faces were confirmed by electronmicrographic observation, based on the major faces being a orthogonal form (the square or rectangle).

At least 50% (preferably 80% or more) of the total projected area of silver halide grains contained in a silver halide emulsion layer relating to the invention is accounted for by tabular silver halide grains.

A silver halide emulsion used in the present invention is silver iodochloride or iodobromochloride having a silver chloride content of 20 mol % or more, preferably 30 mol % or more, and more preferably 70 mol % or more, and a silver iodide content of 1.0 mol % or less (preferably, 0.5 mol % or less).

An emulsion containing silver halide tabular grains is prepared by a process comprising (a) i a silver salt and halide into a dispersing medium tabular nuclear grains, (b) subsequently to the nucleation, Ostwald-ripening under the condition of keeping (100) major faces of the tabular nuclear grains and (c) causing the grains to grow so as to become a desired grain size and chloride content.

As a mode of reacting a silver salt with a halide to form nuclear grains, a double jet method (simultaneously mixing method) is preferably employed.

The double jet method is also employed at the step of grain growth. As a mode of the double jet method is employed a controlled double jet method, in which the pAg of a liquid phase forming silver halide is maintained at a given value. Thereby, a silver halide emulsion close to a regular, uniform grain size.

The silver halide emulsion used in the present invention may be prepared by supplying fine silver halide grains at a part or all of the grain forming process.

The fine grain size controls a supplying rate of halide ions, depending on the grain size or halide composition of host grains. is An average sphere equivalent diameter is preferably not more than 0.3 $\mu$m, more preferably not more than 0.1 $\mu$m. The fine grain size is preferably less than a sphere equivalent diameter of the host grains so that the fine grains deposit on the host grains by recrystalization. More preferably, the fine grain size is 1/10 or less of that of the host grains.

After completing grain growth, a silver halide emulsion is subjected to desalting such as the noodle washing method or flocculation washing method to remove water soluble salts and make the pAg suitable for chemical sensitization. As preferred washing are cited a technique of using an aromatic hydrocarbon aldehyde resin described in Japanese Patent examined 35-16086 and a technique of using polymeric flocculant, G-3 and G-8 described in JP-A 2-7037. Further, ultrafiltration may be usable, as described in Research Disclosure (RD) Vol.102, 1972, October, Item 10208 and Vol.131, 1975, March, Item 13122.

In the silver halide emulsion relating to the invention, binder is used as a protective colloid to envelop silver halide. For the purpose thereof, gelatin, synthetic polymer such as polyvinyl alcohol and polyamide, colloidal albumin, polysaccharides and cellulose derivatives are used as a photographic binder.

Chemical ripening

The silver halide emulsion used in the invention is subjected to chemical ripening. The condition in the chemical ripening process, such as pH, pAg, temperature or time is not specifically limited. The chemical ripening is conducted in a manner conventional in the art. Sulfur sensitization with the use of a compound containing sulfur capable of reacting with a silver ion or active gelatin, selenium sensitization with the use of a selenium compound, tellurium sensitization with use of a tellurium compound, reduction sensitization with the use of a reducing compound and noble metal sensitization with the use of gold or other noble metals are used for chemical sensitization singly or in combination thereof. Among these are preferably used the selenium sensitization and tellurium sensitization.

Selenium sensitizers usable in the selenium sensitization include various selenium compounds, as described in U.S. Pat. Nos. 1,574,944, 1,602,592 and 1,623,499, JP-A 60-150046, 4-25832, 4-109240 and 4-147250. As examples of usable selenium sensitizers are cited colloidal selenium, isoselenocyanates such as allylisoselenocyanate; selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonyl-selenourea and N,N,N'-trimethyl-N'-nitrophenylcarbonyl-selenourea; selenoketones such as selenoacetone and selenoacetophenone; selenoamides such as selenoacetoamide and N,N-dimethylselenobenzamide; selenocarboxylic acids and selenoesters such as 2-selenopropionic acid and methyl-3-selenobutylate; selenophosphates such as tri-p-triselenophosphate; selenides such as triphenylphosphine selenide, diethyl selenide and diethyl selenide. Among these selenium sensitizers are preferred selenoureas, selenoamides, selenoketones and selenides.

Besides the above-described patents, the technique for using the selenium sensitizer are exemplarily described in U.S. Pat. Nos. 3,297,446, 3,297,447, 3,320,069, 3,408,196, 3,408,197, 3,442,653, 3,420,670 and 3,591,385; French Patents 2,63,038 and 2,093,209; Japanese Patents examined 52-34491, 52-34492, 53-295 and 57-22090; JP-A 59-180536, 59-185330, 59-181337, 59-187338, 59-102241, 60-151637, 61-246738, 3-4221, 3-24537, 3-111838, 3-116132, 3-148648,3-237450, 4-16838, 4-32831, 4-96050, 4-140738, 4-140739, 4-1494374-184331, 4-190225, 4-191729 and 4-195035; British Patents 255,846 and 861, 984. It is also disclosed in H. E. Spencer et al., Journal of photographic Science Vol. 31, pages 158–169 (1983).

The tellurium sensitization including its sensitizer is described in U.S. Pat. Nos. 1,623,499, 3,320,069, 3,772,031, 3,531,289 and 3,655,394; British Patents 235,211, 1,121, 496, 1,295,462 and 1,396,696; Canadian Patent 800,958; JP-A 4-204640 and 4-333043. As examples of usable tellurium sensitizers are cited telluroureas such as N,N-dimethyltellurourea, tetramethyltellurourea, N-carboxyethyl-N,N'-dimethyltellurourea and N,N'-dimethyl-N'-phenyltellurourea; phosphine tellurides such as tributylphosphine telluride, tricyclohexylphosphine telluride, triisopropylphosphine telluride, butyldiisopropylphosphine telluride and dibutylphenylphosphine telluride; telluroamides such as telluroacetoamide and N,N-dimethyltellurobenzamide; telluroketones; telluroesters and isotellurocyanates.

Technique for using the tellurium sensitizer is similar to that for selenium sensitizer.

The silver halide emulsion used in the invention can be spectrally sensitized by use of various sensitizing dye known in the art, such as cyanine dyes. The sensitizing dye may be used singly or in combination thereof. A combination of the sensitizing dyes is often used for the purpose of supersensitization.

Various techniques applicable to the silver halide photographic light sensitive material of the invention are described in RD 17643 (December, 1978), ibid 18716 (November, 1979) and 308119 (December, 1989).

X-ray intensifying screen

In the case where the present invention is applied to X-ray radiography for medical use, there is employed an X-ray intensifying screen having, as a main component, a fluorescent substance capable of emitting near-ultraviolet ray or visible light when exposed to penetrating radiation. The intensifying screens are brought into contact with both sides of the photo graphic material coated on both sides of the support with emulsion layers and subjected to exposure. The penetrating radiation refers to electromagnetic wave with high energy, such as X-ray and $\gamma$-ray.

Preferred fluorescent substances used in the intensifying screen include tungstate fluorescent substances ($CaWO_4$, $MgWO_4$, $CaWO_4$: Pb); terbium-activated rare earth oxysulfide fluorescent substances [$Y_2O_2S$:Tb, $Gd_2O_2S$:Tb, $La_2O_2S$:Tb, $(Y.Gd)_2O_2S$:Tb, $(Y.Gd)O_2S$:Tb.Tm; terbium-activated rare earth phosphate fluorescent substances ($YPO_4$:Tb, $GdPO_4$:Tb, $LaPO_4$:Tb); terbium-activated rare earth oxyhalide fluorescent substances (LaOBr:Tb, LaOBr:Tb, Tm, LaOCl: Tb, Tm, GdOBr:Tb, GdOCl) and thulium-activated rare earth oxyhalide fluorescent substances (LaOBr:Tm, LaOCl:Tm); barium sulfate fluorescent substances [$BaSO_4$:Pb, $BaSO_4$:$Eu^{2+}$, (Ba.Sr)$SO_4$:$Eu^{2+}$]; bivalent europium-activated alkali earth metal phosphate fluorescent substances [$(Ba_2PO_4)_2$:$Eu^{2+}$, $(Ba_2PO_4)_2$:$Eu^{2+}$]; bivalent europium-activated alkali earth metal fluorohalide fluorescent substances [BaFCl:$Eu^{2+}$, BaFBr:$Eu^{2+}$, BaFCl:$Eu^{2+}$.Tb, $BaF_2$.BaCl.KCl:$Eu^{2+}$(Ba.Mg)$F_2$.BaCl.KCl:$Eu^{2+}$]; iodide fluorescent substances [ZnS:Ag (Zn.Cd) S:Ag, (Zn.Cd(S:Cu, (Zn.Cd)S:Cu.Al]; hafnium phosphate fluorescent substances ($HfP_2O_7$:Cu); tantalate fluorescent substances ($YTaO_4$, YTaO4:Tm, $YTaO_4$:Nb, [Y,Sr]$TaO_4$:Nb, $GdTaO_4$:Tm, $GD_2O_3$.$Ta_2O_5$.$B_2O_5$:Tb].

It is preferred to fill the fluorescent substance in sloped grain structure to form the intensifying screen. Specifically, it is preferred that a fluorescent substance with a large particle size is coated in the surface protective layer-side and another fluorescent substance with smaller particle size is coated in the support-side. The small particle size is in the range of 0.5 to 2.0 $\mu$m and larger one is 10 to 30 $\mu$m.

For producing the above-mentioned radiographic intensifying screen, it is preferable to produce it by a production method including 1) a step forming a fluorescent substance sheet composed of a binder and a fluorescent substance
2) a step providing the above-mentioned fluorescent substance sheet on a support and adhering the above-mentioned fluorescent substance sheet on the support while compressing at a softening temperature or melting point or more of the above-mentioned binder.

First of all, step 1) will be explained. The fluorescent substance sheet which is a fluorescent substance layer of a radiographic intensifying screen can be produced by coating a coating solution, wherein a fluorescent substance is dispersed uniformly in a binder solution, on a tentative support for forming the fluorescent substance sheet, drying and peeling it off from the tentative support. Namely, first of all, a binder and fluorescent substance particles are added to an appropriate organic solvent and then, stirred to prepare a coating solution wherein the fluorescent substance is dispersed uniformly in the binder solution.

As a binder, a thermoplastic elastomer whose softening temperature or a melting point is 30° to 150° C. is used singly or in combination with other binder polymers. The thermoplastic elastomer has elasticity at room temperature and has fluidity when heated. Therefore, it can prevent damage of the fluorescent substance due to pressure in compression. As examples of a thermo-plastic elastomer, polystyrene, polyolefin, polyurethane, polyester, polyamide, polybutadiene, ethylene vinyl acetate copolymer, poly vinyl chloride, natural rubbers, fluorine-containing rubbers, polyisoprene, chlorinated polyethylene, styrene-butadiene rubbers and silicone rubbers are cited. The component ratio of thermo-plastic elastomer in the binder is allowed to be 10 wt % or more and 100 wt % or less. However, it is desirable that the binder is composed of the thermo-plastic elastomer as much as possible, especially is composed of a thermoplastic elastomer of 100 wt %.

As examples of a solvent for preparing a coating solution, lower alcohols such as methanol, ethanol, n-propanol and n-butanol; chlorine-containing hydrocarbons such as methylenechloride and ethylenechloride; ketones such as acetone, methylethylketone and methylisobutylketone; esters of lower fatty acids and lower alcohols such as methyl acetate, ethyl acetate and butyl acetate; ethers such as dioxane, ethyleneglycolmonoethylether and ethyleneglycoholmonomethylether and their mixtures can be cited. The mixture ratio between the binder and the fluorescent substance in the coating solution varies depending upon the characteristic of the radiographic intensifying screen and the kind of fluorescent substance. Generally, the mixture ratio of the binder and the fluorescent substance is from 1:1 to 1:100 (by weight), and preferably from 1:8 to 1:40 (by weight).

Various additives such as a dispersant for improving dispersing property of a fluorescent substance in aforesaid coating solution and a plasticizer for improving binding force between a binder and a fluorescent substance in the fluorescent substance layer after being formed may be mixed Examples of a dispersant used for the above-mentioned purpose include phthalic acid, stearic acid, caprolic acid and lipophilic surfactants may be cited. Examples of a plasticizer include phosphates such as triphenyl phosphate, tricresyl phosphate and diphenyl phosphate; phthalates such as diethyl phthalate and dimethoxyethyl phthalate; ester glycols such as ethylphthalylethyl glycolate and butylphthalylbutyl glycolate; and polyesters of polyethylene glycols and aliphatic dibasic acids such as polyester of triethylene glycol and adipic acid and polyester between diethylene glycol and succinic acid are cited.

Next, the coating layer is formed by coating the coating solution containing the fluorescent substance and the binder prepared in the above-mentioned manner on the tentative support for forming a sheet uniformly. This coating operation can be conducted by the use of a conventional means such as a doctor blade method, a roll coater method and a knife coater method.

A material of the tentative support can be selected from glass, metal plate or conventional materials as a support for an intensifying screen of X-ray. Examples of such materials include plastic films such as cellulose acetate, polyester, polyethylene terephthalate, polyamide, polyimide, triacetate and polycarbonate, metallic sheets such as aluminium foil and aluminium alloy foil, an ordinary paper, baryta paper, resin-coated paper, pigment paper containing a pigment such as titanium dioxide, paper wherein polyvinyl alcohol is subjected to sizing, ceramic plates or sheets such as alumina, zirconia, magnesia and titania. A coating solution for forming the fluorescent substance layer is coated on the tentative support and dried. Following this, the coating layer is peeled off from the tentative support so that the fluorescent substance sheet which will be a fluorescent substance layer of a radiographic intensifying screen is formed. Therefore, it is desirable that a mold-releasing agent is coated on the surface of the tentative support and that the fluorescent substance sheet formed is easily peeled off from the tentative support.

Next, step 2) will be explained. First of all, a support for a fluorescent substance sheet prepared in the above-mentioned manner is prepared. This support can be selected arbitrarily from the same materials as those used for a tentative support used in forming the fluorescent substance sheet.

In a conventional radiographic intensifying screen, in order to strengthen binding between a support and a fluorescent substance layer and in order to improve sensitivity or image quality (sharpness and graininess) as the radiographic intensifying screen, it is known to coat a polymer substance such as gelatin as an adhesive layer on the surface of a support on the side of the fluorescent substance layer or to provide thereon a light-reflection layer comprising a light-reflective substance such as titanium dioxide or a light-absorption layer comprising a light-absorptive substance such as carbon black. The support used in the present invention may be provided with each of the above-mentioned layer. The constitution may be arbitrarily selected depending upon the purpose and application of the desired radiographic intensifying screen. The fluorescent substance sheet obtained through step 1) is loaded on a support. Next, the fluorescent substance sheet is stuck on the support while compressing it at a softening temperature or a melting point or higher of the binder.

In the above-mentioned manner, by the use of a method that compress the fluorescent substance sheet without fixing it on the support in advance, the sheet can be spread thinly. Accordingly, it prevents damage of the fluorescent substance. In addition, compared to a case wherein the sheet is fixed for being pressed, a higher fluorescent substance filling rate can be obtained even with the same pressure. Examples of a compressor used for compressing processing of the present invention include conventional ones such as a calendar roll and a hot press. In compression processing by the use of the calendar roll, the fluorescent substance sheet obtained through step a) is loaded on the support, and then, the sheet is passed through rollers heated to the softening temperature or the melting point of the binder or higher at a certain speed. However, a compressor used for the present invention is not limited thereto. Any compressing means can be used, provided that it can compress the sheet while heating it. The compression pressure is preferably 50 kg/cm$^2$ or more.

In an ordinary radiographic intensifying screen, a transparent protective layer is provided for protecting the fluorescent substance layer physically and chemically on the surface of the fluorescent substance layer opposite to that being in contact with the support, as described before. Such a protective layer is preferably provided in the radiographic intensifying screen of the present invention. Layer thickness of the protective layer is ordinarily in a range from about 0.1 to 20 $\mu$m. The transparent protective layer can be formed by a method that coats a solution prepared by dissolving a transparent polymer such as cellulose derivatives including cellulose acetate and nitro cellulose; and a synthetic polymer including polymethyl methacrylate, polyvinyl butylal, polyvinyl formal, polycarbonate, polyvinyl acetate, vinyl chloride-vinyl acetate copolymer on the surface of the fluorescent substance layer. In addition, the transparent protective layer can also be formed by a method that forms a sheet for forming a protective layer such as a plastic sheet composed of polyethylene terephthalate, polyethylene naphthalate, polyethylene, polyvinylidene chloride or polyamide; and a protective layer forming sheet such as a transparent glass plate is formed separately and they are stuck on the surface of the fluorescent substance layer by the use of an appropriate adhesive agent.

As a protective layer used for the radiographic intensifying screen of the present invention, a layer formed by a coating layer containing an organic solvent soluble fluorescent resin is preferable. As a fluorescent resin, a polymer of a fluorine-containing olefin (fluoro olefin) or a copolymer of a fluorine-containing olefin is cited. A layer formed by a fluorine resin coating layer may be cross-linked. When a protective layer composed of a fluorine resin is provided, dirt exuded from a film in contacting with other materials and an X-ray film is difficult to come into inside of the protective layer. Therefore, it has an advantage that it is easy to remove dirt by wiping. When an organic solvent soluble fluorescent resin is used as a material for forming a protective layer, it can be formed easily by coating a solution prepared by dissolving this resin in a suitable solvent and drying it. Namely, the protective layer is formed by coating the protective layer forming material coating solution containing the organic solvent soluble fluorine resin on the surface of fluorescent layer uniformly by the use of the doctor blade and by drying it. This formation of a protective layer may be conducted concurrently with the formation of the fluorescent substance layer by the use of multilayer coating.

The fluorine resin is a homopolymer or copolymer of a fluorine containing olefin (fluoroolefin). Its examples include polytetrafluoroethylene, polychlorotrifluoroethylene, polyvinyl fluoride, polyvinylidene fluoride, tetrafluoroethylene-hexafluoropropylene copolymer and fluoroolefin-vinyl ether copolymer. Though fluorine resins are insoluble in an organic solvent, copolymers of fluoroolefins as a copolymer component are soluble in an organic solvent depending upon other constituting units (other than fluoroolefin) of the copolymers. Therefore, the protective layer can be formed easily by coating a solution wherein the aforesaid resin is dissolved in a suitable solvent for preparing on the fluorescent substance layer to be dried. Examples of the above-mentioned copolymers include fluoroolefin-vinyl ether copolymer. In addition, polytetrafluoroethylene and its denatured product are soluble in a suitable fluorine-containing organic solvent such as a perfluoro solvent. Therefore, they can form a protective layer in the same manner as in the copolymer containing the above-mentioned fluoroolefin as a copolymer component.

To the protective layer, resins other than the fluorine resin may be incorporated. A cross-linking agent, a hardener and an anti-yellowing agent may be incorporated. However, in order to attain the above-mentioned object sufficiently, the content of the fluorine resin in the protective layer is suitably 30 wt % or more, preferably 50 wt % or more and more preferably 70 wt % or more. Examples of resin incorporated in the protective layer other than the fluorine resin include a polyurethane resin, a polyacrylic resin, a cellulose derivative, polymethylmethacrylate, a polyester resin and an epoxy resin.

The protective layer for the radiographic intensifying screen used in the present invention may be formed by either of an oligomer containing a polysiloxane skeleton or an oligomer containing a perfluoroalkyl group or by both thereof. The oligomer containing the polysiloxane skeleton has, for example, a dimethyl polysiloxane skeleton. It is preferable to have at least one functional group (for example, a hydroxyl group). In addition, the molecular weight (weight average) is preferably in a range from 500 to 100000, more preferably 1000 to 100000, especially more preferably 3000 to 10000. In addition, the oligomer containing the perfluoroalkyl group (for example, a tetrafluoroethylene group) preferably contains at least one functional group (for example, a hydroxyl group: —OH) in a molecule. Its molecular weight (weight average) is 500 to 100000, more preferably 1000 to 100000 and especially preferably 10000 to 100000. When an oligomer containing a functional group is used, cross-linking reaction occurs between the oligomer and a resin for forming a protective layer in forming the protective layer so that the oligomer is taken into a molecule structure of the layer-forming resin. Therefore, even when the X-ray conversion panel is used for a long time repeatedly or cleaning operation of the surface of the protective layer is carried out, the oligomer is not taken off from the protective layer. Therefore, the addition of the oligomer becomes effective for a long time so that use of the oligomer having a functional group becomes advantageous. The oligomer is contained in the protective layer preferably in an amount of 0.01 to 10 wt % and especially 0.1 to 2 wt %.

In the protective layer, perfluoro olefin resin powder or silicone resin powder may be added. As the perfluoro olefin resin powder or the silicone resin powder, those having an average particle size of preferably 0.1 to 10 μm, and more preferably 0.3 to 5 μm. The above-mentioned perfluoro olefin resin powder or the silicone resin powder is added to the protective layer preferably in an amount of 0.5 to 30 wt % and more preferably 2 to 20 wt % and especially preferably 5 to 15 wt %.

The protective layer of the intensifying screen is preferably a transparent synthetic resin layer coated on the fluorescent substance layer and having a thickness of 5 μm or less. The use of a thick protective layer leads to shorten the distance between the intensifying screen and a silver halide emulsion and therefore enhance sharpness of the resulting X-ray photographic image.

A filling ratio of the fluorescent as defined in the present invention can be determined from a ratio of the void in the fluorescent substance layer coated on the support, according to the following equation.

$$Vair/V = \frac{(a+b)px\,pyV - A(apx + bpy)}{V[(a+b)px\,py - apy\,pair - bpx\,pair]} \quad \text{Equation (1)}$$

wherein

V; total volume of fluorescent substance layer

Vair; volume of air in fluorescent substance

A; total weight of fluorescent substance px; density of fluorescent substance py; density of binder pair; density of air a; weight of fluorescent substance b; weight of binder.

In the above equation, since "pair" is nearly zero, the equation (1) is approximately represented by the following equation (2).

$$Vair/V = \frac{(a+b)px\,pyV - A(apx + bpy)}{V[(a+b)px\,py]} \quad \text{Equation (2)}$$

In the above, the definition of V, Vair, px, py, A, a and b is the same as that in (1). In the invention, the ratio of the void was determined from equation (2). The ratio of the void of the fluorescent substance can be determined from the following equation (3).

$$\frac{A\,apx}{V[(a+b)px\,py]} \quad \text{Equation (3)}$$

In the above, the definition of V, Vair, px, py, A, a and b is the same as that in (1).

The intensifying screen according to the invention is preferably used in a combination of a intensifying screen (A) capable of absorbing not less than 40% of X-ray with an X-ray energy of 80 kVp and a intensifying screen (B) capable of absorbing not less than 50%, wherein (B) is larger in an absorbing amount than (A). The absorbing amount of the intensifying screen can be measured by the following method.

The X-ray which is produced from a tungsten target tube at 80 kVp by three phase power supply is allowed to transmit through an aluminum plate with a thickness of 3 mm and reach an intensifying screen fixed at the position of 200 cm farther from the tungsten anode of the target tube. Subsequently, the amount of X-ray which is transmitted through the intensifying screen is measure at the position of 50 cm behind the screen by a ionization dosimeter.

The thickness of the intensifying screen is within the range of 125 to 200 μm, in which the void ratio of the fluorescent substance is 65% or more.

The photographic material of the invention is processes by use of processing solutions described in RD-17643, XX–XXI, pages 29–30 and RD-308119, XX–XXI, pages 1011–1012.

Dihydroxybenzenes such as hydroquinone, 3-pyrazolidones such as 1-phenyl-3-pyrazolidone and aminophenols such as N-methyl-aminophenol are used singly or in combination thereof, as a developing agent used in black-and-white photography. A developing solution may optionally contain a preserver, alkali agent, pH buffering agent, antifoggant, hardener, development accelerating agent, surfactant, defoamer, toning agent, water-softener, dissolving aid or thickener.

A fixing agent such as a thiosulfate or thiocyanate is used in a fixer. Further, a water soluble aluminum salt such as aluminum sulfate or potassium alum may be contained as a hardener. In addition, preserver, pH-adjusting agent, water-softener may be contained.

In an automatic processor used in the invention which has mechanism of supplying a solid processing composition to a processing bath, known methods disclosed in Japanese Utility Model open to public inspection (OPI) publication 63-137783, 63-97522 and 1-85732 are available as a supplying means, in the case of the solid processing composition in a tablet form. If at least function for supplying the tablet to a processing bath is provided, any method may be usable. In the case of a solid processing composition in the form of granules or powder, gravity drop system described in Japanese Utility Model OPI publication 62-81964, 63-84151 and 1-292375, and screw-driving system described in Japanese Utility Model OPI publication 63-105159 and 63-195345 are known methods, but the present invention is not limited to these methods. The solid processing composition may be dropped in any portion of a processing bath. It is preferably the portion which is connected to a processing section and in which a processing solution flows to the processing portion. It is more preferably a structure in which a given amount of the processing solution circulates between the connected portion and the processing section and dissolved components are transferred to the processing section. The solid processing composition is preferably dropped into a temperature-controlled processing solution.

Dihydroxybenzenes described in Japanese Patent Application 4-286232 (pages 19–20), aminophenols, pyrazolidones and reductones are usable, as a developing agent, in a developer used in a processing method relating to the present invention. Among the pyrazolidones are preferred those substituted at the 4-position (Dimezone, Dimezone-S), which are water soluble and superior in storage stability when used in the form of the solid composition.

The photographic material of the invention can be processed with a developer and/or developer replenishing solution containing a compound represented by formula (1), using an automatic processor. Next, the compound represented by formula (1) will be explained more in detail.

Formula (1)

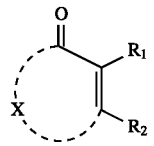

In the formula, $R_1$ and $R_2$ each represent a hydroxy group, amino group, acylamino group, alkylsulfonylamino group, arylsulfonylamino group, alkoxycarbonylamino group, mercapto group and alkylthio group; X represents a group of atoms necessary for forming a ring, preferably comprised of carbon atom, oxygen atom or nitrogen atom. The ring is 5 or 6-membered one including two vinyl carbon substituted by $R_1$ and $R_2$, and carbonyl carbon. Concretely, $R_1$ and $R_2$ independently represent a hydroxy group, amino group (which may be substituted by an alkyl group having 1 to 10 carbon atoms such as methyl, ethyl, n-butyl or hydroxyethyl), acylamino group (i.e., acetyl amino, benzoylamino, etc.); alkylsulfonylamino group (benzenesulfonylamino, p-toluenesulfonylamino, etc.); alkoxycarbonylamino group (methoxycarbonylamino group etc.); mercapto group; alkylthio group (methylthio, ethylthio etc.). As preferred examples of $R_1$ and $R_2$ are cited a hydroxy group, amino group, alkylsulfonylamino group and arylsulfonylamino group. X is a 5- or 6-membered ring, preferably comprised of a carbon atom, oxygen atom or nitrogen atom. Thus, X is comprised of a combination of —O—, —C($r_3$)($R_4$)—, —C($R_5$)=, —C(=O)—, —N($R_6$)—, and —N=, in which $R_3$, $R_4$, $R_5$ and $R_6$ independently represent a hydrogen atom, alkyl group having 1 to 10 carbon atoms (which may be substituted by a hydroxy, carboxy or sulfo group), aryl group having 6 to 15 carbon atoms (which may be substituted by an alkyl group, halogen atom, hydroxy, carboxy or sulfo group), hydroxy group or carboxy group. The 5- or 6-membered ring includes saturated or unsaturated condensed ring. Examples of the 5- or 6-membered ring include a dihydrofuranone ring, dihydropyrrone ring, pyranone ring, cyclopentenone ring, cyclohexenone ring, pyrrolinone ring, pyrazolinone ring, pyridone ring, azacyclohexenone ring, and uracil ring. Among these are preferred a dihydrofuranone ring, cyclopentenone ring, cyclohexenone ring, pyrazolinone ring, azacyclohexenone ring and uracil ring. Examples of the compounds represented by formula (1) are shown as below, but the present invention is not limited thereto.

A-1

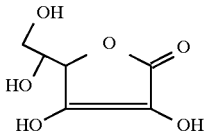

A-2

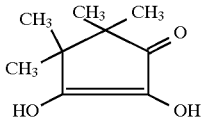

A-3

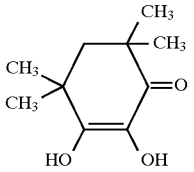

A-4

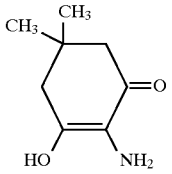

-continued

A-5

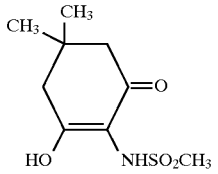

A-6

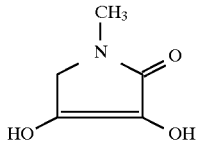

A-7

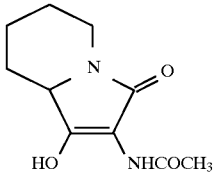

A-8

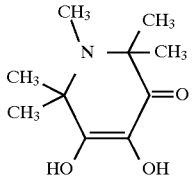

A-9

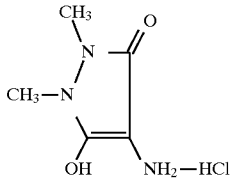

A-10

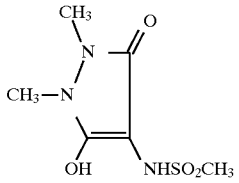

A-11

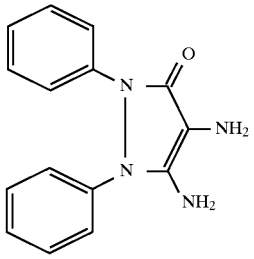

A-12

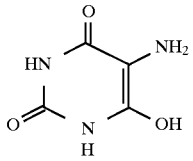

-continued

A-13

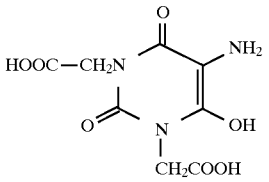

A-14

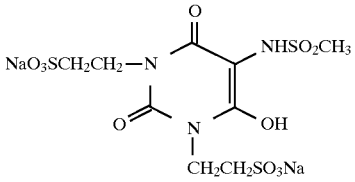

A-15

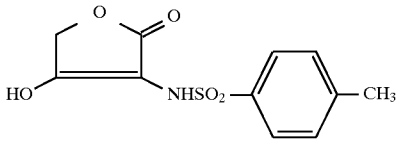

A-16

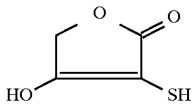

A-17

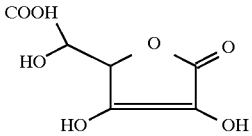

A-18

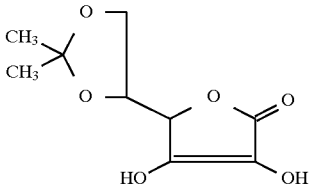

A-19

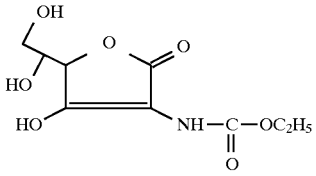

A-20

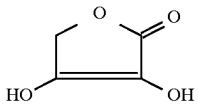

A-21

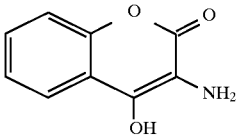

A-22

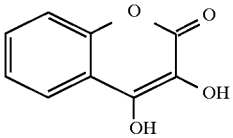

-continued

A-23

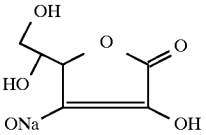

The compound may be added to a developer in an amount of 0.005 to 0.5, preferably 0.02 to 0.4 mol per liter of the developer.

As a preservative is usable an organic reducing agent as well as sulfites described in Japanese Patent Application No. 4-286232. In addition, a chelating agent and bisulfite adduct described in Japanese Patent Application No. 4-586323 (on page 20 and 21, respectively) are usable. As a antisludging agent is usable a compound described in Japanese Patent Application No. 5-96118 (general formulas [4-a] and [4-b]). Cyclodextrin compounds are preferably used, as described in JP-A 1-124853. An amine compound, particularly as described in U.S. Pat. No. 4,269,929 may be added to a developing solution.

It is necessary to use a buffering agent in a developing solution. Examples of the buffering agent include sodium carbonate, potassium carbonate, sodium bicarbonate, potassium bicarbonate, trisodium phosphate, disodium phosphate, sodium borate, potassium borate, sodium o-hydroxybenzoate (sodium salicylate), potassium o-hydroxybenzoate, sodium 5-sulfo-2-hydroxybenzoate (sodium 5-sulfosalicylate), sodium 5-sulfo-2-hydroxybenzoate (sodium 5-sulfosalicylate).

As a development accelerating agent are cited thioether compounds described in Japanese Patent examined 37-16088, 37-5987, 38-7826, 44-12380, 45-9019 and U.S. Pat. No. 3,813,247; p-phenylenediamine compounds described in JP-A 52-49828, 50-15554; quaternary ammonium salts described in Japanese Patent examined 44-30074, JP-A 50-137726, 52-43429 and 56-156826; p-aminophenols described in U.S. Pat. Nos. 2,610,122 and 4,119,462; amine compounds described in U.S. Pat. Nos. 2,482,546, 2,494,903, 2,596,926, 3,128,182, 3,582,346, 4,230,796, 3,253,919; polyalkylene compounds described in Japanese Patent 37-16088, 41-11431, 42-23883, 42-25201, U.S. Pat. Nos. 3,128,183, 3,532,501; 1-phenyl-3-pyrazolidones; hydrozines; mesoion type compound and imidazoles.

Alkali metal halides such as potassium iodide are used as a antifoggant. Organic antifoggants include benzotriazole, 6-nitrobenzimidazole, 5-nitrobenzimidazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, adenine and 1-pheny-5-mercaptotetrazole.

Further, methylcellosolve, methanol, acetone, dimethylformamide, cyclodetrine compounds or compounds described in Japanese Patent examined 47-33378 and 44-9509 can be used as a solvent for increasing a solubility of a developing agent. Furthermore, various additives such as an antistaining agent, antisludging agent and interlayer effect-accelerating compound are optionally added.

A fixing agent, chelating agent, pH buffering agent, hardening agent and preservative known in the art can be added into a fixing solution, as described JP-A 4-242246 and 5-113632. A chelating agent, as a hardener or a bisulfite adduct of a hardener, as described in Japanese Patent Application 4-586323 is also usable in the fixing solution.

It is preferred to add a starter prior to processing. A solidified starter is also preferred. An organic acid such as polycarboxylic acid compound, alkali earth metal halide, organic restrainer or development accelerator is used as a starter.

According to the processing applicable to the present invention, the silver halide photographic light sensitive material is processed, using an automatic processor, within a total processing time of 10 to 45 sec. and preferably 15 to 30 sec. The total processing time refers to the process of from developing to drying being completed with 45 sec. by using an automatic processor. Thus, a period of from the time of the top of the photographic material being dipped into a developer to the time of the top coming out from the drying zone (i.e., Dry to Dry time) is within 45 sec. The "developing process time" or "developing time" in the invention refers to a period of from the time when the top of a photographic material is dipped in a developer tank solution of an automatic processor to the time when the top is dipped in a fixer tank solution; the "fixing time" refers to a period of from the time of being dipped in a fixer tank solution to the time of being dipped in the next washer (or stabilizer) tank solution; and the "washing time" refers to a period of time of being dipped in a washer tank solution. The processor is conventionally provided with a drying zone by impingement of hot-air with a temperature of 35° to 100°, preferably 40° to 80° C. The "drying time" refers to a period of time of being in the drying zone. In the processing relating to the invention, the developing time is 3 to 15, preferably 3 to 10 sec. at a temperature of 25° to 50°, preferably 30° to 40° C. The fixing temperature and time each are preferably 20° to 50° C. and 2 to 12 sec., more preferably 30° to 40° C. and 2 to 10 sec. The washing or stabilizing time each are preferably 0° to 50° C. and 2 to 15 sec., more preferably, 15° to 40° C. and 2 to 8 sec. According to the invention, developed, fixed and washed (or stabilized) photographic material is squeezed through squeegee rollers and then dried. The drying is carried out at a temperature of 40° to 100° C. and the drying time is optimally variable, depending on an environment temperature. The drying time is conventionally 3 to 12 sec., preferably 3 to 8 sec. at 40° to 80° C.

In processing a silver halide photographic light sensitive material of the invention with an automatic processor, the use of a processor comprising a drying process provided with a transport roller (heat roller) of which periphery is heated with a heat source is preferred from the point of drying efficiency. The transport roller preferably has a heat source inside of it.

In the invention, the photographic material can be processed at a replenishing rate of a developer or fixer of from 4 to 216 ml per $m^2$ of the material.

EXAMPLES

The present invention will be explained based on examples, but embodiments of the invention is not limited thereto.

Example 1

Preparation of seed emulsion EM-A

A seed emulsion EM-A was prepared as follows.

| | |
|---|---|
| Solution A1 | |
| Ossein gelatin | 100 g |
| Potassium bromide | 2.05 g |
| Water to make | 11.5 l |
| Solution B1 | |
| Ossein gelatin | 55 g |
| Potassium bromide | 65 g |
| Potassium iodide | 1.8 g |
| 0.2 N Sulfuric acid | 38.5 ml |
| Water to make | 2.61 l |
| Solution C1 | |
| Ossein gelatin | 75 g |
| Potassium bromide | 950 g |
| Potassium iodide | 27 g |
| Water to make | 3.0 l |
| Solution D1 | |
| Silver nitrate | 95 g |
| Water to make | 2.7 l |
| Solution E1 | |
| Silver nitrate | 1410 g |
| Water to make | 3.2 l |

To Solution A1 held at 60° C. in a reactor vessel were added Solutions B1 and D1 by controlled double jet method over a period of 30 min. and then solutions C1 and E1 by controlled double jet method over a period of 105 min., with stirring at 500 r.p.m.

Addition was conducted at such a flowing rate that no new nuclear grain was produced and broadening of grain size distribution with Ostwald ripening did not occurred. During the addition, the pAg was controlled at 8.3±0.05 using an aqueous potassium solution bromide and the pH was held at 2.0±0.1. After completing the addition, the pH was adjusted to 6.0 and the resulting emulsion was desalting to remove soluble salts according to a method described in Japanese Patent No. 35-16086.

By electronmicroscopic observation, it was proved that the resulting seen emulsion was comprised of slightly roundish cube-formed tetradecahedral grains with an average grain size of 0.27 μm and a grain size distribution width of 17%. Herein the word, "grain size distribution width" refers to a variation coefficient of grain size, represented by (standard deviation of grain size)/(average grain size)×100 (%).

Preparation of emulsion EM-1

Using the seed emulsion EM-A and the following solutions, monodispersed core/shell type emulsion was prepared.

| | |
|---|---|
| Solution A2 | |
| Ossein gelatin | 10 g |
| Aqueous ammonia solution (28%) | 23 ml |
| Glacial acetic acid | 3 ml |
| Seed emulsion EN-A | 0.119 mol equiv. |
| Water to make | 600 ml |
| Solution B2 | |
| Ossein gelatin | 0.8 g |
| Potassium bromide | 5 g |
| potassium iodide | 3 g |
| water to make | 110 ml |
| Solution C2 | |
| Ossein gelatin | 2 g |
| Potassium bromide | 90 g |
| Water to make | 240 ml |
| Solution D2 | |
| Silver nitrate | 9.9 g |
| Aqueous ammonia solution (28%) | 7.0 ml |
| Water to make | 110 ml |
| Solution E2 | |
| Silver nitrate | 130 g |
| Aqueous ammonia solution (28%) | 100 ml |

-continued

| | |
|---|---|
| Water to make | 240 ml |
| Solution F2 | |
| Potassium bromide | 94 g |
| Water to make | 165 ml |
| Solution G2 | |
| Silver nitrate | 9.9 g |
| Aqueous ammonia solution (28%) | 7.0 ml |
| Water to make | 110 ml |

Solution A2 was hold at 40° C., with stirring at 800 r.p.m. with a stirrer. The AN was adjusted to 9.90 with acetic acid, a seed emulsion EM-A was added to be dispersed, and then Solution G2 was added thereto at a constant flow rate over a period of 7 min., while being kept at a pAg of 7.3. Subsequently, Solutions B2 and D2 were simultaneously added over a period of 29 min., while being kept at a pAg of 7.3. Further, after adjusting the pH to 8.83 and pAg to 9.0 using aqueous potassium bromide solution and acetic acid and taking 10 min., solutions C2 and E2 were simultaneously added over a period of 30 min.

During the addition, the flowing rate was increased with time at a ratio of the start to final of 1:10. The pH was decreased from 8.83 to 8.00 in proportion to the flowing amount. When Solution C2 and E2, two third of each were added, Solution F2 was further added thereto at a constant flow rate over a period of 8 min., while the pAg was increased from 9.0 to 11.0. Thereafter, the pH was adjusted to 6.0 with acetic acid.

After completing the addition, using an aqueous solution of Demol (product by Kao-Atlas) and an aqueous magnesium sulfate solution, the resulting emulsion was desalted to remove soluble salts. Thereafter, the pAg and pH were respectively adjusted to 8.5 and 5.85 at 40° C. The emulsion having an average silver iodide content of 2 mol % was obtained.

By electronmicroscopic observation, it was proved that the resulting emulsion was comprised of slightly roundish cube-formed tetradecahedral grains with an average grain size of 0.55 μm and a variation coefficient of 14%.

Preparation of hexagonal tabular seed emulsion

A hexagonal tabular silver bromide seed emulsion EM-B was prepared in the following manner.

| | |
|---|---|
| Solution A3 | |
| Ossein gelatin | 60.2 g |
| Distilled water | 20.0 l |
| HO—$(CH_2CH_2O)$n-$[CH(CH_3)CH_2O]_{17}(CH_2CH_2O)$mH (m + n = 5 − 7) 10% methanol solution | 5.6 ml |
| Potassium bromide | 26.8 g |
| 10% sulfuric acid | 144 ml |
| Solution B3 | |
| Silver nitrate | 1487.5 g |
| Distilled water | 3500 ml |
| Solution C3 | |
| Potassium bromide | 1050 g |
| Distilled water | 3500 ml |
| Solution D3 | |
| 1.75 N Aqueous potassium bromide solution for use in controlling silver potential | |

To Solution A3 were added Solutions B3 and C3, 64.1 ml of each by double jet method over a period of 2 min. to form nuclear grains, while being maintained at 35° C. and stirred with a stirrer described in Japanese Patent No. 58-58288.

After interrupting the addition of Solutions B3 and C3, the mixture solution was heated to 60° C. by taking 60 min. and then Solutions B3 and C3 were simultaneously added at a flow rate of 68.5 ml/min. over a period of 50 min., while being maintained, with Solution D3, at +6 mV of a silver potential, which was measured by a silver ion selection electrode with a saturated silver/silver chloride reference electrode. After completing the addition, the pH was adjusted to 6 with an aqueous 3% potassium hydroxide solution and then the emulsion was desalted to obtain a seed emulsion EM-B. As a result of electronmicroscopic observation, it was proved that at least 90% of the grain projected area of the thus prepared emulsion EM-B was accounted for by hexagonal tabular grains with a maximum adjacent edge ratio of 1.0 to 2.0, average thickness of 0.07 μm, an average grain size (circular equivalent diameter) of 0.5 μm and variation coefficient of grain size of 25%.

Preparation of emulsion EM-2

A tabular grain emulsion was prepared by forming silver bromide on the tabular seed grains using the following solutions.

| | |
|---|---|
| Solution A4 | |
| Ossein gelatin | 29.4 g |
| HO—$(CH_2CH_2O)$n-$[CH(CH_3)CH_2O]_{17}(CH_2CH_2O)$mH (m + n = 5 − 7) 10% methanol solution | 1.25 ml |
| Seed emulsion EM-B | 2.65 mol equiv. |
| Distilled water to make | 3000 ml |
| Solution B4 | |
| 3.5 N Silver nitrate aqueous solution | 1760 ml |
| Solution C4 | |
| Potassium bromide | 737 g |
| Distilled water to make | 1760 ml |
| Solution D4 | |
| 1.75 N Aqueous potassium bromide solution for use in controlling silver potential | |

To Solution A4, Solutions B4 and C4 were added by double jet method, over a period of 110 min., at an accelerated flow rate (three times from start to finish), while being maintained at 60° C. and stirred with a stirrer described in Japanese Patent No. 58-58288. During the addition, the silver potential was maintained at +40 mV with Solution D4.

After completing addition, the emulsion was subjected to coagulation desalting to remove soluble salts, according to the following procedure.

1. After completing addition, the reaction mixture is adjusted to 40° C., an exemplified coagulating gelatin (G-3) is added thereto in an amount of 20 g/mol AgX and the pH is adjusted to 4.30 with 56 wt. % acetic acid, the mixture being allowed to stand and then subjected to decantation.
2. Water at 40° C. is added in an amount of 1.8 l/mol AgX. After being stirred for 10 min., the mixture is allowed to stand and subjected to decantation.
3. The above procedure 2 is repeated one more time.
4. Second gelatin of 15 g/mol AgX, sodium carbonate and water are added and the mixture is dispersed at a pH of 6.0 to make up 450 cc/mol AgX.

About 3000 grains of the resulting emulsion EM-2 were observed by an electronmicroscope to make analysis with respect to grain shape. As a result, it was proved that at least 80% of the total grain projected area was accounted for by hexagonal tabular grains with an aspect ratio of 2 or more, an average circular-equivalent diameter of 0.59 μm, average thickness of 0.17 μm and a variation coefficient of 24%.

Preparation of high chloride tabular seed emulsion EM-C:

| | |
|---|---|
| Solution A5 | |
| Ossein gelatin | 37.5 g |
| Potassium iodide | 0.625 g |
| Sodium chloride | 16.5 g |
| Distilled water to make | 7500 ml |
| Solution B5 | |
| Silver nitrate | 1500 g |
| Distilled water to make | 2500 ml |
| Solution C5 | |
| Potassium iodide | 4 g |
| Sodium chloride | 140 g |
| Distilled water to make | 684 ml |
| Solution D5 | |
| Sodium chloride | 375 g |
| Distilled water to make | 1816 ml |

To Solution AS maintained at 40° C. with stirring with stirrer described in Japanese patent No. 58-58288, 684 ml of Solution B5 and the total amount of Solution C5 were added, over a period of 1 min. After Ostwald-ripening at EAg of 149 mV over a period of 20 min., the residual amount of Solution C5 and the total amount of Solution D5 were added thereto over a period of 40 min., while being controlled at EAg of 149 mV.

After completing addition, the emulsion was desalted to obtain a seed emulsion EM-C. As a result of electronmicroscopic observation, it was proved that not less than 60% of the total projected area of silver halide grains was accounted for by tabular grains having (100) major faces, an aspect ratio of 2 or more, average thickness of 0.07 μm, average diameter of 0.5 μm and a variation coefficient of 25%.

Preparation of emulsion EM-3

A tabular silver halide emulsion was prepared by forming silver chloride on the seed grains (EM-C), using the following solutions.

| | |
|---|---|
| Solution A6 | |
| Ossein gelatin | 29.4 g |
| HO—$(CH_2CH_2O)$n-$[CH(CH_3)CH_2O]_{17}$ $(CH_2CH_2O)$mH (m + n = 5 − 7) 10% methanol solution | 1.25 ml |
| Seed emulsion EM-C | 0.98 mol equiv. |
| Distilled water to make | 3000 ml |
| Solution B6 | |
| 3.5 N Silver nitrate aqueous solution | 2240 ml |
| Solution C6 | |
| Sodium chloride | 455 g |
| Distilled water to make | 2240 ml |
| Solution D6 | |
| 1.75 N Aqueous sodium chloride solution for use in controlling silver potential | |

To Solution A6, Solutions B6 and C6 were added by double jet method, over a period of 110 min., at an accelerated flow rate (three times from start to finish), while being maintained at 40° C. and stirred with a stirrer described in Japanese Patent No. 58-58288. During the addition, the silver potential was maintained at +120 mV with Solution D6.

After completing addition, the emulsion was subjected to coagulation desalting to remove soluble salts, in the same manner as in EM-1.

About 3000 grains of the resulting emulsion EM-3 were observed by an electronmicroscope to make analysis with respect to grain shape. As a result, it was proved that at least 80% of the total grain projected area was accounted for by tabular grains having (100) major faces, an aspect ratio of 2 or more, average diameter of 1.17 μm, average thickness of 0.12 μm and a variation coefficient of 24%.

Preparation of tabular silver bromochloride emulsion EM-4

A tabular grain emulsion EM-4 was prepared in the same manner as in EM-3, except that 473 g of potassium bromide was further added to Solution C6 and the silver potential was controlled at +100 mV during the addition of Solutions B6 and C6.

About 3000 grains of the resulting emulsion EM-4 were observed by an electronmicroscope to make analysis with respect to grain shape. As a result, it was proved that at least 80% of the total grain projected area was accounted for by tabular grains having (100) major faces, an aspect ratio of 2 or more, average diameter of 1.17 μm, average thickness of 0.12 μm and a variation coefficient of 24%.

Preparation of silver iodide fine grains

| | |
|---|---|
| Solution A7 | |
| Ossein gelatin | 100 g |
| Potassium iodide | 8.5 g |
| Distilled water to make | 2000 ml |
| solution B7 | |
| Silver nitrate | 360 g |
| Distilled water to make | 605 ml |
| Solution C7 | |
| Potassium iodide | 352 g |
| Distilled water to make | 605 ml |

To Solution A7 in a reactor vessel at 40° C. with stirring were added Solutions B7 and C7 by double jet method at a constant flow rate over a period of 30 min., while being maintained at a pAg of 13.5 by a conventional pAg controlling means.

The resulting silver iodide was fine grains with an average size of 0.06 μm, which were a mixture of β-AgI and γ-AgI.

Preparation of solid fine particle dispersion of spectral sensitizing dye

A mixture of 5,5'-dichloro-9-ethyl-3,3'-di-(3-sulfopropyl)-oxacarbocyanine anhydride (Sensitizing dye) and 5,5'-di-(butoxycarbonyl)-1,1'-diethyl-3,3'-di-94-sulfobutyl) benzoimidazolocarbocyanine sodium anhydride (Sensitizing dye B) in a ratio of 100:1 were added to water maintained at 27° C. and dispersed by stirring over a period of 30 to 120 min. by a high speed stirring machine (dissolver) at 3500 r.p.m. to obtain a solid fine particle dispersion of the dyes. The dispersion was prepared so as to have a concentration of Dye A of 2%.

Gold-sulfur sensitization

Emulsions EM-1 to EM-4 each were subjected to spectral sensitization and chemical sensitization in the following manner to obtain chemically sensitized emulsions A-1 to A-4. Thus, after heating each of the emulsions to 50° C., the solid particle dispersion of the dyes were added to the emulsion in such an amount that Dye A was 460 mg per mol silver, and then chemical sensitization was optimally carried out by adding ammonium thiocyanate of $7.0\times10^{-4}$ mol/Ag mol, potassium chloroaurate and sodium thiosulfate. Further, afore-described silver iodide fine grain emulsion of $3\times10^{-3}$ mol/Ag mol was added and thereafter, 4-hydroxy-6-methyl-1,3,3a,7-tetrazaindene (TAI) of $3\times10^{-2}$ mol/Ag mol was added to stabilize the emulsion.

Selenium sensitization

Emulsions EM-3 and EM-4 each were subjected to spectral sensitization and chemical sensitization in the following manner to obtain chemically sensitized emulsions B-3 and B-4. Thus, after heating each of the emulsions to 50° C., the solid particle dispersion of the dyes were added to the emulsion in such an amount that Dye A was 460 mg per mol silver, and then chemical sensitization was optimally carried out by adding ammonium thiocyanate of $7.0\times10^{-4}$ mol/ Ag mol, potassium chloroaurate, sodium thiosulfate and triphenylphosphine selenide of $3.0\times10^{-6}$ mol/Ag mol. Further, afore-described silver iodide fine grain emulsion of $3\times10^{-3}$ mol/Ag mol was added and thereafter, TAI of $3\times10^{-2}$ mol/Ag mol was added to stabilize the emulsion.

Tellurium sensitization

Emulsions EM-3 and EM-4 each were subjected to spectral sensitization and chemical sensitization in the following manner to obtain chemically sensitized emulsions C-3 and C-4. Thus, after heating each of the emulsions to 50° C., the solid particle dispersion of the dyes were added to the emulsion in such an amount that Dye A was 460 mg per mol silver, and then chemical sensitization was optimally carried out by adding ammonium thiocyanate of $7.0\times10^{-4}$ mol/ Ag mol, potassium chloroaurate, sodium thiosulfate and tributylphosphine telluride of $3.0\times10^{-6}$ mol/Ag mol. Further, afore-described silver iodide fine grain emulsion of $3\times10^{-3}$ mol/Ag mol was added and thereafter, TAI of $3\times10^{-2}$ mol/Ag mol was added to stabilize the emulsion.

To the thus chemically sensitized emulsions A-1 to A-4, B-3, B-4, C-3 and C-4 were added later-described additives to prepare coating solutions of an emulsion layer. There was also prepared a coating solution of a protective layer.

Preparation of subbed support

On both sides of a bliue-tinted polyethylene terephthalate film base for use in a X-ray film with a density of 0.170 and a thickness of 175 μm, which were subjected to corona discharge treatment at 0.5 kV·A·min./$m^2$, a latex solution for subcoat (L-2), as described below was coated so as to have a dry thickness of 0.2 μm and then L-1 as below was coated so as to have a dry thickness of 0.053 μm, and dried an 123° C. for 2 min. Thus prepared support was referred to as Support 1.

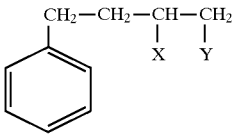

(L-1)

X:COOH or COONa
Y:COONa or $COOCH_2CF_2CF_2H$ (L-2):

A latex solution (solid component, 30%) of a copolymer comprised of n-butylacrylate (10 wt. %), t-butylacrylate (35 wt. %), styrene (27 wt. %) and 2-hydroxyethylacrylate (28 wt. %).

On one side of the film base was provided the same sublayer as Support 1 and on the other side, a mixture of tin oxide ($SnO_2$) sol prepared in Synthesis Example 1, afore-described L-2 and L-1 in a ratio by volume of 35:15:50 was coated so as to have a dry thickness of 0.12 μm and a coating amount of the sol component of 250 mg/$m^2$, and further thereon mixture of L-1 and L-3 in a ratio by volume of 70:30 was coated so as to have a dry thickness of 0.053 μm, being dried at 120° C. for 1 min. The base film was previously subjected to corona discharge treatment at 0.5 kV·A·min./$m^2$. The thus prepared support was referred to as Support 2.

(L-3):

A mixture of 34.02 weight parts of dimethyl terephthalate, 25.52 weight parts of dimethyl isophthalate, 12.97 weight parts of dimethyl 5-sulfoisophthalate sodium salt, 47.85 weight parts of ethylene glycol, 18.95 weight parts of 1,4-cyclohexanedimethanol, 0.065 weight parts of calcium acetate monohydrate and 0.022 weight parts of manganese acetate was subjected to ester exchange reaction at 170° to 220° C. under nitrogen gas, while methanol was distilled away. Thereafter, 0.04 weight parts of trimethyl phosphate, 0.04 weight parts of antimonyl trioxide as a polycondensation catalyst and 15.08 weight parts of 1,4-dicyclohexanedicarboxylic acid were added, and a theoretical amount of water was almost distilled away at a reaction temperature of 220° to 235° C. to complete esterification. Further, the reaction system was evacuated with heating by taking one hour and polycondensation was carried out at 280° C. and 1 mm Hg or less over a period of one hour to obtain polyester product (intrinsic viscosity of 0.35).

To 7300 g of an aqueous solution of the thus prepared polyester polymer, 30 g of styrene, 30 g of butyl methaacrylate, 20 g of glycidyl methaacrylate, 20 g of acrylamide and 1.0 g of ammonium persulfate were added to be reacted at 80° C. over a period of 5 hr. The reaction product was cooled down to a room temperature and adjusted so as to have a solid component of 10 wt. %. A coating solution was thus-prepared.

(L-4):

A latex solution of a copolymer comprised of n-butylacrylate (40 wt. %), styrene (20 wt. %) and glycidyl methaacrylate (40 wt. %).

Preparation of photographic material

On both sides of each of Support 1 and Support 2, coating solutions of a cross-over light shielding layer, emulsion layer and protective layer were simultaneously coated so as to have the following amount and dried.

| First layer (Cross-over light shielding layer) | |
|---|---|
| Solid particle dispersion of dye (AHD) | 180 mg/$m^2$ |
| Gelatin | 0.2 mg/$m^2$ |
| Sodium dodecylbenzenesulfonate | 5 mg/$m^2$ |
| Compound (I) | 5 mg/$m^2$ |
| 2,4-Dichloro-6-hydroxy-1,3,5-triazine sodium salt | 5 mg/$m^2$ |
| Colloidal silica (av. size 0.014 μm) | 10 mg/$m^2$ |
| Second layer (Emulsion layer) | |
| (The following additives were added to the emulsion above-described.) | |
| Compound (G) | 0.5 mg/$m^2$ |
| 2,6-Bis(hydroxyamino)-4-diethylamino-1,3,5-triazine | 5 mg/$m^2$ |
| t-Butyl-catechol | 130 mg/$m^2$ |
| Polyvinyl pyrrolidone (M.W. 10,000) | 35 mg/$m^2$ |

-continued

| | |
|---|---|
| Styrene-anhydrous maleic acid copolymer | 80 mg/m$^2$ |
| Sodium polystyrenesulfonate | 80 mg/m$^2$ |
| Trimethylolpropane | 350 mg/m$^2$ |
| Diethylene glycol | 50 mg/m$^2$ |
| Nitrophenyl-triphenyl-phosphonium chloride | 20 mg/m$^2$ |
| Ammonium 1,3-dihydroxybenzene-4-sulfonate | 500 mg/m$^2$ |
| Sodium 2-mercaptobenzimidazole-5-sulfonate | 5 mg/m$^2$ |
| Compound (H) | 0.5 mg/m$^2$ |
| n-$C_4H_9OCH_2CH(OH)CH_2N(CH_2COOH)_2$ | 350 mg/m$^2$ |
| COMPOUND (M) | 5 mg/m$^2$ |
| Compound (N) | 5 mg/m$^2$ |
| Colloidal silica | 0.5 mg/m$^2$ |
| Latex (L) | 0.2 mg/m$^2$ |
| Dextrin (av. M.W. 1000) | 0.2 mg/m$^2$ |
| (Gelatin was coated so as to be 1.0 g/m$^2$, in total.) | |

Third layer (Protective layer-1 containing nonionic surfactant)

| | |
|---|---|
| Gelatin | 0.8 g/m$^2$ |
| Matting agent of polymethyl methaacrylate (area-averaged particle size 7.0 $\mu$m) | 50 mg/m$^2$ |
| Formaldehyde | 20 mg/m$^2$ |
| 2,4-Dichloro-6-hydroxy-1,3,5-triazine sodium salt | 10 mg/m$^2$ |
| Bis-vinylsulfonylmethyl ether | 36 mg/m$^2$ |
| Latex (L) | 0.2 g/m$^2$ |
| Polyacrylamide (av. M.W. 10000) | 0.1 g/m$^2$ |
| Polyacrylic acid sodium salt | 30 mg/m$^2$ |
| Compound (SI) | 20 mg/m$^2$ |
| Compound (I) | 12 mg/m$^2$ |
| Compound (J) | 2 mg/m$^2$ |
| Compound (S-1) | 7 mg/m$^2$ |
| Compound (K) | 15 mg/m$^2$ |
| Compound (O) | 50 mg/m$^2$ |
| Compound (S-2) | 5 mg/m$^2$ |
| $C_9F_{19}-O-(CH_2CH_2O)_{11}-H$ | 3 mg/m$^2$ |
| $C_8F_{17}SO_2N(C_3H_7)-(CH_2CH_2O)_{15}H$ | 2 mg/m$^2$ |
| $C_8F_{17}SO_2N(C_3H_7)-(CH_2CH_2O)_4H-(CH_2)_4SO_3Na$ | 1 mg/m$^2$ |

Third layer (Protective layer-2 not containing nonionic surfactant)

| | |
|---|---|
| Gelatin | 0.8 g/m$^2$ |
| Matting agent of polymethyl methaacrylate (area-averaged particle size 7.0 $\mu$m) | 50 mg/m$^2$ |
| Formaldehyde | 20 mg/m$^2$ |
| 2,4-Dichloro-6-hydroxy-1,3,5-triazine sodium salt | 10 mg/m$^2$ |
| Bis-vinylsulfonylmethyl ether | 36 mg/m$^2$ |
| Latex (L) | 0.2 g/m$^2$ |
| Polyacrylamide (av. M.W. 10000) | 0.1 g/m$^2$ |
| Polyacrylic acid sodium salt | 30 mg/m$^2$ |
| Compound (SI) | 20 mg/m$^2$ |
| Compound (I) | 12 mg/m$^2$ |
| Compound (S-1) | 7 mg/m$^2$ |
| Compound (S-2) | 5 mg/m$^2$ |
| $C_9F_{19}-O-(CH_2CH_2O)_{11}-H$ | 3 mg/m$^2$ |
| $C_8F_{17}SO_2N(C_3H_7)-(CH_2CH_2O)_{15}H$ | 2 mg/m$^2$ |
| $C_8F_{17}SO_2N(C_3H_7)-(CH_2CH_2O)_4H-(CH_2)_4SO_3Na$ | 1 mg/m$^2$ |

Latex (L)

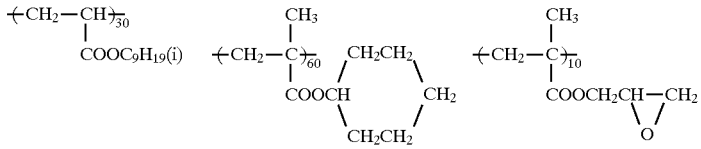

Compound (I)

-continued
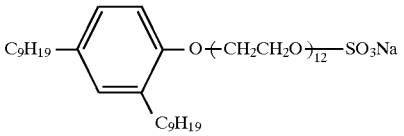
Compound (G)
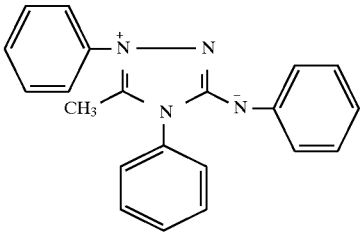
Compound (H)
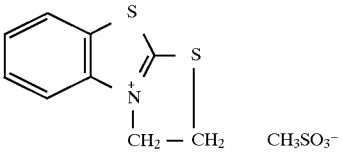
Dye in the form of solid particle dispersion (AH)
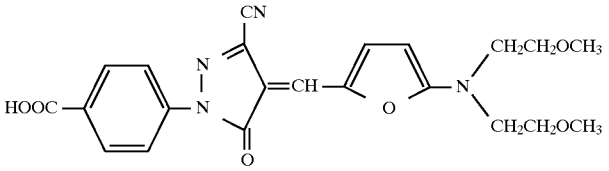
Compound (M)
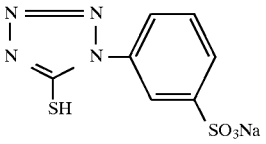
Compound (N)
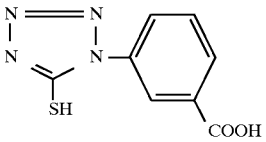
Compound (J)
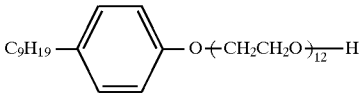
Compound (SI)
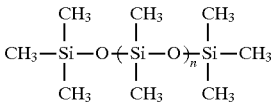
n ≒ ~1000
Compound (S-1)

-continued $NaO_3S—CH(CH_2COO(CH_2)_9CH_3)COO(CH_2)_2CH(CH_3)_2$

Compound (K)

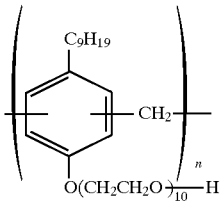

(Mixture of n = 2–5)

Compound (O)
$C_{11}H_{23}CONH(CH_2CH_2O)_5H$
Compound (S-2)

$SO_3Na—CH(CHCOO(CH_2)_9CH_3)COO(CH_2)_2CH(CH_3)_2$

A protective layer, which was selected from Protective layers 1 and 2 was coated. The coating amounts of additives were expressed in per one side of the photographic material and silver coverage was 1.7 g/m$^2$ of the one side.

Preparation of radiographic intensifying screen

| | |
|---|---|
| Fluorescent substance $Gd_2O_2S$:Tb (average particle size, 1.8 $\mu$m) | 200 g |
| Polyurethane type thermoplastic elastomer Deluxe TPKL-5-2625, solid component of 40% (product by Sumitomo Bayer Corp.) | 20 g |
| Nitrocellulose (nitration degree of 11.5%) | 2 g |

To the above was added methylethylketone as a solvent and the mixture was dispersed with a propeller type mixer to obtain a coating solution for fluorescent substance forming layer with a viscosity of 25 ps at 25° C.

Binder/Fluorescent substance=1/22

Separately, 90 g of soft type acrylic resin, 50 g of nitrocellulose were added to methylethylketone to be dispersed to obtain a dispersion with a viscosity of 3 to 6 ps at 25° C., as a coating solution to form a sublayer.

A polyethylene terephthalate base (support) compounded with titanium dioxide and with a thickness of 250 $\mu$m was horizontally placed on a glass plate and thereon was uniformly coated the coating solution of the sublayer above-described by using a doctor blade. Thereafter, the coated layer was dried with slowly increasing a temperature from 25° to 100° C. to form the sublayer on the support. A thickness of the sublayer was 15 $\mu$m.

Further thereon was coated the coating solution of the fluorescent substance in a thickness of 240 $\mu$m by using a doctor blade and dried, and subjected to compression. The compression was conducted by means of a calendar roll at a pressure of 800 kgw/cm$^2$ and a temperature of 80° C. After compression, a transparent protective layer was formed in accordance with the method described in Example 1 of JP-A 6-75097. There was thus prepared radiographic intensifying screen 1 comprising a support, sublayer, fluorescent substance layer and transparent protective layer.

Preparation of developer-replenisher tablet

A developer-replenisher in the form of a tablet was prepared according to the following operation (A) and (B).

Operation (A)

12500 g of sodium erythorbic acid, as a developing agent was ground into grain until an average grain size became 10 $\mu$m using a commercially available bandom mill. 2000 g of sodium sulfite, 2700 g of Dimezon S (1-phenyl-4-hydroxymethyl-4-methyl-3-pyrazolidone) and 1250 g of DTPA (diethylenetriaminepentaacetic acid, pentasodium salt), 12.5 g of 5-methylbenzotriazole, 4 g of 1-phenyl-5-mercaptotetrazole and 60 g of N-acetyl-D,L-penicilamine were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 1670 g of polyethylene glycol 6000 and 1670 g of mannitol using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 8.77 g per tablet, for use as developer-replenisher.

Operation (B)

4000 g of potassium carbonate, 2100 g of mannitol and 2100 g of polyethylene glycol #6000 were ground to form granules in a similar manner to the operation (A). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (B) having a weight of 3.28 g per tablet, for use as developer-replenisher.

Preparation of fixer-replenisher tablet

A replenisher of a fixer in the form of a tablet was prepared according to the following operations.

Operation (C)

14000 g of a mixture of ammonium thiosulfate/sodium thiosulfate (70/30 by weight) and 1500 g of sodium sulfite were ground and mixed using commercially available mixing machine. Adding water of 500 ml, the mixture was granulated in a similar manner to the operation (A). After granulation, the granules were dried at 60° C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 2500 tablets (C) having a weight of 6.202 g per tablet, for use as fixed-replenisher.

Operation (D)

1000 g of boric acid, 1500 g of aluminum sulfate 18 hydrate, 3000 g of sodium hydrogen acetate (equimolar mixture of glacial acetic acid and sodium acetate) and 200 g of tartaric acid were ground and mixed in a similar manner to the above operation (A). Adding water of 100 ml, the mixture was granulated in a similar manner to the operation (A). After granulation, the granules were dried at 50 C. for 30 min. to almost completely remove moisture contained. Thereafter, 4 g of N-lauroylalanine was added thereto and the mixture was subjected to compression-molding on a modified tabletting machine, Tough Press Collect 1527 HU, produced by Kikusui Manufacturing Co., Ltd. to prepare 1250 tablets (D) having a weight of 4.562 g per tablet, for use as fixed-replenisher.

Evaluation of photographic materials

Photographic materials each were sandwiched between the intensifying screens and exposed to X-ray through a penetrometer type B (product by Konica Medical Corp.) so as to give a density of 1.0 and subjected to running-processing. Photographic materials of 200 sheets with full square size (35.6×35.6 cm) were continuously processed using an automatic processor, SRX-502, which was further provided with a input member of a solid processing composition in the form of a tablet and heat-rollers as transport rollers in the drying section, and modified so as to complete processing in 25 sec. Variation in sensitivity (%) was evaluated, with reference to the sensitivity at the start of processing:

$$\Delta S=(S-S_0)/S_0\times 100(\%)$$

where $S_0$ and S represent sensitivities at the start and finish of running-processing, respectively.

During running-processing, to the developer solution were added tablets (A) and (B), each 2 tablets and 76 ml of water per 0.62 $m^2$ of the photographic material. When each of the tablets (A) and (B) was dissolved in water of 38 ml, the pH was 10.70. To the fixer solution were added 2 tablets of (C) and 1 tablet of (D) per 0.62 $m^2$ with 74 ml of water. Addition of water was started at the same time of that of the tablets and continued at a constant rate further for 10 min. in proportion to a dissolving rate of the solid processing composition. Processed photographic materials were evaluated with respect to sensitivity variation (in percentage) at the time of completion of the running-processing, on the basis of the sensitivity at the start of the running-processing.

Processing condition

| | | |
|---|---|---|
| Developing: | 35° C. | 8.2 sec. |
| Fixing: | 33° C. | 5 sec. |
| Washing: | Ordinary temperature | 4.5 sec. |
| Squeegee: | | 1.6 sec. |
| Drying: | 40° C. | 5.7 sec. |
| Total processing time: | | 25 sec. |

At the start of processing, developer-replenisher tablets (A) and (B), each 434 tablets were dissolved in water to prepare a developer of 16.5 liters and 330 ml of the starter was added to the developer to prepare a starting developer solution. The developer solution was introduced into a developer bath and then processing was started. The pH of the developer solution was 10.45.

Starter for developer

| | |
|---|---|
| Glacial acetic acid | 2.98 g |
| KBr | 4.0 g |
| Water to make | 1 liter |

A starting solution of a fixer was prepared by dissolving the fixed-replenisher tablets (C) of 298 g equivalent and (D) of 149 g equivalent in water to make 11.01 liters, which was introduced into a fixer bath.

Evaluation of oil sludge

Photographic material films of 1,000 sheets with full square size (35.6×35.6 cm) were exposed so as to give a density of 0.9 and continuously processed. After completing the processing, processing solutions were allowed to stand over a period of 6 hr. and then, 10 sheets of unexposed films were further subjected to processing. The resulting films processed were visually observed and evaluated, based on the following criteria.

5: No oil sludge was observed

4: Occurrence of the sludge was slightly observed within 1 cm of the edge of the processed film.

3: Roller's pitch-like sludge was partially observed in an amount of about two tenth of the following criterion 2.

2: Streak-like sludge was overall observed along the roller's pitch.

1: Sludge overall occurred in an amount of not less than 20 within 5 $cm^2$.

Evaluation of occurrence of static mark

Unexposed photographic material samples were allowed to stand at 25° C. and 20% R.H. for 2 hr. Thereafter, each of them was rubbed independently with a Neoprene rubber roll and Nylon roller, subjected to processing and evaluated, based on the following criteria.

A: No occurrence of static mark

B: Slight occurrence of static mark

C: Remarkable occurrence of static mark

D: Overall occurrence of static mark

Photographic materials in which a support, emulsion layer and protective layer were combined with each other as shown below were evaluated. Results thereof are shown in Table 1. Sensitivity at the start of processing was shown as a relative value based on the sensitivity of Sample 1 being 100.

TABLE 1

| Sample No. | Emulsion No. | Support | Protective layer | Sensitivity | Variation in sensitivity (%) | Oil sludge | Static mark | Remark |
|---|---|---|---|---|---|---|---|---|
| 1 | A-1 | 1 | 1 | 100 | 8% | 2 | B | Comp. |
| 2 | A-2 | 1 | 1 | 125 | 5% | 2 | B | Comp. |
| 3 | A-3 | 1 | 1 | 100 | 0% | 3 | B | Comp. |
| 4 | A-4 | 1 | 1 | 110 | 3% | 3 | B | Comp. |
| 5 | A-4 | 1 | 2 | 110 | 3% | 3 | B | Comp. |
| 6 | A-1 | 2 | 2 | 100 | 8% | 5 | A | Comp. |
| 7 | A-2 | 2 | 2 | 125 | 5% | 5 | A | Inv. |
| 8 | A-3 | 2 | 2 | 100 | 0% | 5 | A | Inv. |
| 9 | A-4 | 2 | 2 | 110 | 0% | 5 | A | Inv. |
| 10 | A-3 | 2 | 1 | 100 | 0% | 4 | A | Inv. |
| 11 | B-3 | 2 | 2 | 120 | 0% | 5 | A | Inv. |
| 12 | B-4 | 2 | 2 | 132 | 0% | 5 | A | Inv. |
| 13 | B-3 | 2 | 1 | 120 | 0% | 4 | A | Inv. |
| 14 | C-3 | 2 | 2 | 115 | 0% | 5 | A | Inv. |
| 15 | C-4 | 2 | 2 | 127 | 0% | 5 | A | Inv. |

As can be seen from the Table, the photographic material in which the tabular grains of the invention were employer achieved an improvement in process stability even when subjected to rapid processing at a low replenishing rate. It is proved that, although an antistatic means by the use of a conventionally known nonionic polymer produced a problem in fixability, the use of colloidal tin oxide sol solved the problem. Further, it is apparent to be advantageous in sensitivity that silver halide grains relating to the present invention are selenium- or tellurium-sensitized, and from the comparison of the protective layer-1 with the protective layer-2, exclusion of the nonionic polymer from another component layer was also proved to be advantageous.

Example 2

Photographic material samples 7 to 9, 11, 12, 14 and 15 same manner as in Example 1, except that, during running-processing, tablets (A) and (B), each one tablet and 38 ml of water per 0.62 $m^2$ were added, as a replenisher, to the developer solution. Results thereof were shown below, as compared to those of Example 1.

TABLE 2

| Sample No. | Sensitivity |
|---|---|
| 7 | 107 (125) |
| 8 | 97 (100) |
| 9 | 103 (110) |
| 11 | 118 (120) |
| 12 | 127 (132) |
| 14 | 114 (115) |
| 15 | 123 (127) |

Values in parentheses were cited from Table 1 of Example 1. As can be seen from Table 2, Sample 7 led to remarkable decrease in sensitivity, when processed at a lower replenishing rate, as compared to Samples 8, 9, 11, 12, 14 and 15. Thus, it was shown that the use of chloride-containing emulsions such as EM-3 and 4 was advantageous in running procesing, even when subjected to rapid processing at a low replenishing rate.

What is claimed is:

1. A silver halide X-ray photographic light sensitive material comprising a support having on the support a silver halide emulsion layer comprising silver halide grains, wherein at least 50% of the total grain projected area is accounted for by tabular grains having an aspect ratio of 2 or more and containing iodide of 1.0 mol % or less, at least one of subbing layers provided on both sides of the support comprising colloidal tin oxide sol.

2. The silver halide X-ray photographic material of claim 1, wherein said tabular grains have two parallel {100} major faces and contain chloride of 20 mol % or more.

3. The silver halide X-ray photographic material of claim 1, wherein said tabular grains have been selenium-sensitized or tellurium-sensitized.

4. The silver halide X-ray photographic material of claim 2, wherein said tabular grains further contain iodide of 0.5 mol % or less.

5. The silver halide X-ray photographic material of claim 4, wherein said tabular grains have been selenium-sensitized or tellurim-sensitized.

6. The silver halide X-ray photographic material of claim 2, wherein said tabular grains have been selenium-sensitized or tellurim-sensitized.

* * * * *